United States Patent [19]

Wilmer et al.

[11] Patent Number: 4,936,871

[45] Date of Patent: Jun. 26, 1990

[54] METHOD OF COOLING PARTIAL OXIDATION GAS

[75] Inventors: Gerhard Wilmer, Pastoratsweg; Rolf Wetzel, Anemonenweg, both of Fed. Rep. of Germany

[73] Assignee: Krupp Koppers GmbH, Essen, Fed. Rep. of Germany

[21] Appl. No.: 322,073

[22] Filed: Mar. 10, 1989

[30] Foreign Application Priority Data

Mar. 19, 1988 [DE] Fed. Rep. of Germany ..... 3809313

[51] Int. Cl.[5] ..... C10J 3/46; C10J 3/84

[52] U.S. Cl. ..... 48/197 R; 48/206; 48/210; 55/83; 55/84; 55/89; 55/93

[58] Field of Search ..... 48/196 R, 197 R, 202, 48/203, 206, 209, 210, DIG. 2; 252/373; 55/83, 84, 89, 93, 94; 261/17, 79.2, 117, 118, DIG. 54

[56] References Cited

U.S. PATENT DOCUMENTS

| | | | |
|---|---|---|---|
| 2,621,117 | 12/1962 | Garrison | 48/196 R |
| 2,971,830 | 2/1961 | Kawai et al. | 48/206 |
| 3,963,457 | 6/1976 | Hess | 48/206 |
| 4,013,427 | 3/1977 | Gernhardt et al. | 48/197 R |
| 4,054,424 | 10/1977 | Stauderyor et al. | 55/83 |
| 4,157,294 | 6/1979 | Gernhardt et al. | 48/210 |
| 4,810,264 | 3/1989 | Dewitz | 48/210 |

FOREIGN PATENT DOCUMENTS

| | | | |
|---|---|---|---|
| 2718539 | 11/1971 | Fed. Rep. of Germany | 48/206 |
| P3524802.5 | 3/1989 | Fed. Rep. of Germany . | |

*Primary Examiner*—Peter Kratz

*Attorney, Agent, or Firm*—Michael J. Striker

[57] ABSTRACT

Decribed is a method of cooling partial oxidation gas exiting at a temperature between 1,000° and 1,700° C. from a conically converging outlet portion of a reactor vessel into a subsequent tubular cooling zone. To prevent deposition of sticky molten impurities entrained in the gas stream on the walls in the transition region between the reactor vessel and the cooling zone, the outlet portion of the reactor vessel is provided with a ring-shaped slot for injecting at an angle between 0° to 90° a frustoconical stream of cooling fluid. Another ring-shaped slot is provided in the cooling zone to inject at an angle between 70° to 90° another frustoconical stream of cooling fluid into the cooling zone.

5 Claims, 2 Drawing Sheets

METHOD OF COOLING PARTIAL OXIDATION GAS

BACKGROUND OF THE INVENTION

The present invention relates to a method of and a device for cooling a partial oxidation gas produced in a reactor vessel, particularly by partial oxidation of coal having high contents of inerts and/or of other carbon carriers having a high proportion of inorganic impurities. The inner surface of the reactor vessel is lined with a fireproof layer The outlet part of the reactor vessel has a conically converging configuration and communicates with a cylindrical cooling zone. The partial oxidation gas produced in the reactor flows at a temperature between 1,000° and 1,700° C. through the outlet portion into the cooling zone where a stream of cooling medium is injected into the stream of the partial oxidation gas.

During partial oxidation of coal and/or other carbon carriers at temperatures above the slag or sinder melting point, the partial oxidation gas exiting the reactor vessel at a temperature between 1,200° and 1,700° C. entrains molten or sticky solid particles, hence in the further processing of the gas care must be taken that the accompanying sticky impurites do not impair the subsequent processing due to their deposition on the walls of the employed apparatuses, on the surfaces of heat exchangers and/or within the pipes. To meet this objective, attempts have already been made to admix within the cooling zone succeeding the reactor vessel a cooling liquid with hot partial oxidation gas in such a manner that the latter and the impurities entrained therein could be cooled down without permitting the not yet solidified, sticky particles in the gas stream to land on the inner walls of the cooling zone hence to form depositions thereon. For example, from German publication DE-OS No. 35 24 802 a method of cooling a hot, sticky particles containing product gas is known wherein ring shaped stream of a cooling fluid is injected into the product gas in the cooling zone such that the stream has the shape of a truncated cone converging in the direction of the gas stream.

However, the known measures are limited exclusively to the treatment of the partial oxidation gas within the cooling zone connected to the outlet of the reactor vessel. In practice it has been found that in the transition region from the reactor vessel to the cooling zone deposits of incident sticky particles have occurred which cannot be avoided through the measures within the cooling zone, particularly during the partial oxidation of coal rich in inerts and/or other carbon carrying substances having a high proportion of unorganic impurities. The unavoidable growth of such deposits leads to the obstruction of the passage of the gas into the cooling zone and into the subsequently added processing devices. Consequently, the entire plant may become nonfunctional.

SUMMARY OF THE INVENTION

It is, therefore, a general object of the present invention to overcome the aforementioned disadvantages.

More particularly, it is an object of the invention to provide an improved method of the aforementioned kind which effectively precludes the formation of deposits of sticky particles entrained in the partial oxidation gas in the transition region between the reactor vessel and the cooling zone.

Another object of this invention is to still improve the cooling of the partial oxidation gas.

In keeping with these objects and others which will become apparent hereafter, one feature of this invention resides in the provision of an additional ring-shaped stream of the cooling fluid which is injected radially inwardly into the reactor vessel immediately before the entry of the partial oxidation gas into the cooling zone. The additional stream of cooling fluid forms with the inner wall of the reactor vessel an angle between 0° to 90°, and the beforementioned ring-shaped stream of cooling fluid in the cooling zone forms with the inner wall of the latter an angle between 70° and 90°.

The preferred embodiment of the method of this invention has the following features:

The ring-shaped stream of cooling fluid introduced into the reactor vessel has a velocity between 1 to 20 m/s whereas the ring-shaped stream of cooling fluid introduced into the cooling zone has a velocity between 4 to 40 m/s.

The ratio of the stream of cooling fluid injected into the reactor vessel to the stream of cooling fluid injected into the cooling zone is selected from the range between 1 and 4.

The flow velocity of the partial oxidation gas stream is adjusted such that together with the stream of cooling fluid injected into the reactor vessel it flows into the cooling zone with a velocity larger than 1 m/s.

With advantage, a cooled down and purified partial oxidation gas is used as the cooling fluid. Of course, also other fluid media such as vapor, steam or even preheated water can be used for this purpose.

Preferably the angles of inclination of the ring-shaped streams of cooling liquid injected into the reactor vessel and into the cooling zone are adjusted so that in each case the stream forms a jacket of a truncated cone converging in the direction of streaming of the partial oxidation gas.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
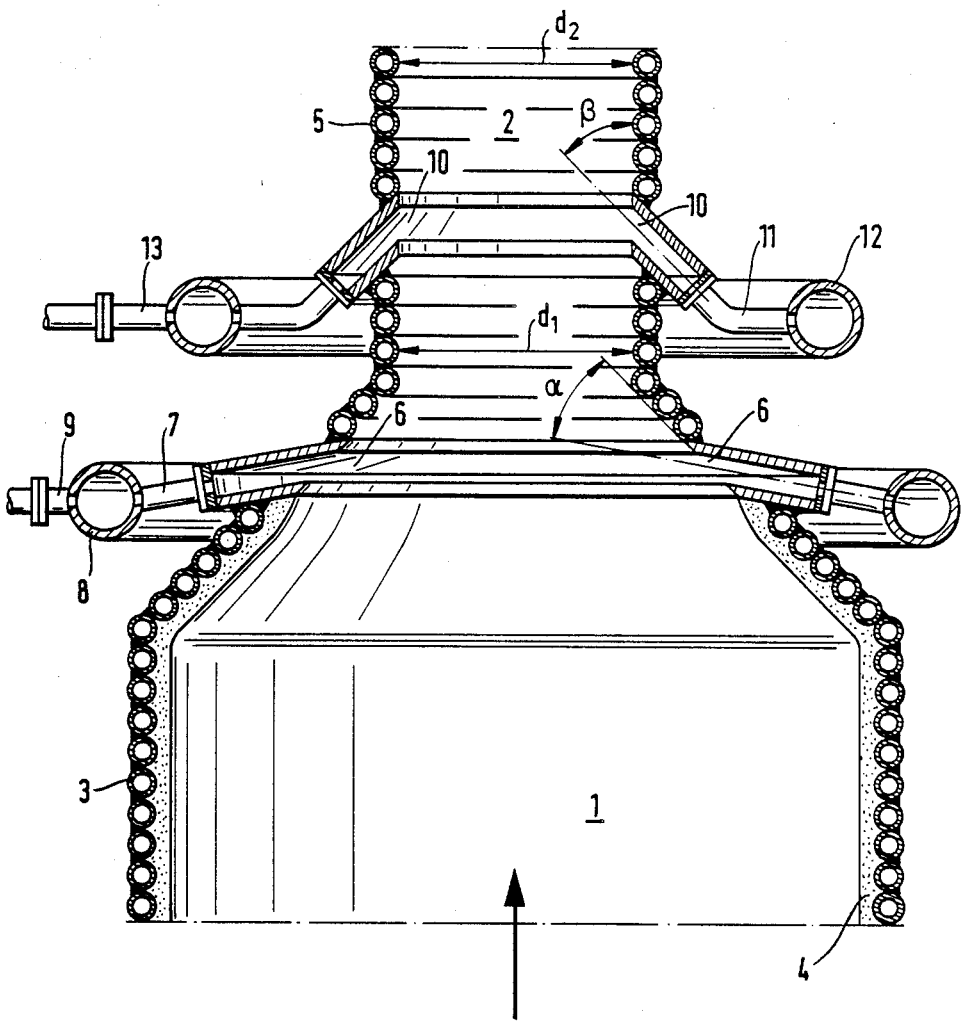
FIG. 1 is a schematic sectional view of the transition area between a reactor vessel and a cooling zone.

The device illustrated in FIG. 1 consists of a reactor vessel 1 and a cylindrical cooling zone 2 connected to the outlet opening of the reactor vessel. Both the outlet opening and the cooling zone have a smaller diameter than that of the reactor vessel. Consequently, the latter has an upwardly converging top portion whose walls form a truncated cone. The reactor vessel 1 includes a cooled wall 3 which on its inner surface is coated with a fireproof lining 4. For the sake of clarity the drawing illustrates only the transition area between the reactor vessel 1 and the cooling zone 2 whereby the lower part of the reactor with conventional gasification burners and slag removing means are omitted because they are not important for the disclosure of this invention. The reactor vessel 1 is constructed in a conventional manner as a gasification reactor. Wall 5 of the cooling zone 2 is also cooled but its inner surface has no fireproof lining. In the preferred embodiment, the walls 3 and 5 are constructed as pipe walls indicated in FIG. 2, whereby a cooling medium circulates through the wall 5. The cooling zone 2 and the reactor vessel 1 have a common center axis.

Figure 2:
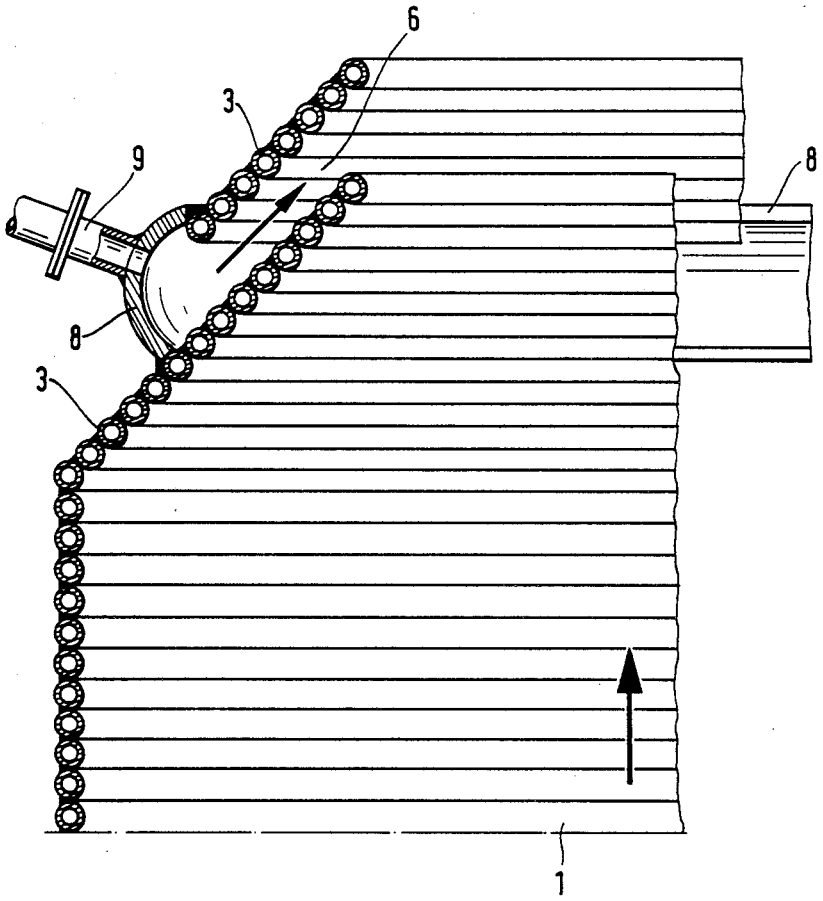
FIG. 2 is a schematic sectional side view of a part of the outlet portion of the reactor vessel with an annular slot for introducing a stream of cooling fluid at an angle of 0° with the inner surface of the outlet portion.

According to the invention the frustoconical outlet part of reactor vessel 1 is provided immediately before the outlet opening for partial oxidation gas with a ring-shaped slot 6 extending over the entire circumference of the sloping wall of the outlet part of the vessel and serves for injecting a partial stream of cooling fluid into the reactor vessel 1. For this purpose, the ring-shaped slot 6 is connected via an annular connection piece 7 with a circular conduit 8 communicating with supply line 9 for the cooling fluid. As it has been mentioned before, the ring-shaped stream of cooling fluid at this location should form with the inner surface of the outlet part of the reactor vessel an angle between 0°–90°. Therefore, the ring-shaped slot 6 and its connection piece 7 to the supplying and distributing conduits must be inclined relative to the inner surface of the wall 3 at an angle $\alpha$ whose value is within the above range. In a limit case the stream of cooling fluid forms an angle 0° with the wall 3 so as to be injected parallel to the latter. In this case the construction of the sloping wall of the outlet part of the reactor vessel as illustrated in FIG. 2, must be employed. The cooling fluid from the distributing circular conduit 8 flows upwards parallel to the overlapping pipe wall portion 3 in the sloping part of the reactor vessel 1 and is injected in the transition range between the reactor vessel 1 and the cooling zone 2. As a result the stream of cooling fluid forms in this transition range a frustoconical jacket or a closed flat ring surrounding the exiting stream of the partial oxidation gas. The jacket stream solidifies the finely divided sticky particles which at the entry of the partial oxidation gas into the cooling zone do not follow the restricted profile of the gas stream in the outlet opening, before these particles come in contact with the inner wall of the cooling zone at its entry area. Moreover, the frustoconical jacket stream of the cooling fluid causes a notably reduced concentration of these particles in this wall region. The resulting elimination of any deposition of such particles in this wall region, as mentioned before, is a basic presumption for proper functionability of the cooling zone 2. It has been found experimentally that depositions in this wall range lead to turbulences of the partial oxidation gas stream entering the cooling zone 2 and that these turbulences interfere with the proper mixing process between the cooling fluid and the partial oxidation gas. The proper mixing of these two fluids is necessary for the prevention of deposits of sticky particles in the range of the cooling zone 2. As mentioned before, with a strong growth of the deposits in the inlet region of the cooling zone the throughflow of the partial oxidation gas is considerably impaired and under circumstances completely interrupted. The deposits which may under circumstances form below the ring-shaped gap 6 can develop due to the influence of the fireproof lining and the hot partial oxidation gas stream only to a limited extent and do not interfere with the function and configuration of the cooling liquid stream in the wall range at the inlets of the cooling zone.

In the cooling zone 2 a second stream of cooling fluid is injected through the ring-shaped slot 10. Similarly as in the reactor vessel, the ring-shaped slot 10 communicates via a connection piece 11 with the circular distributing conduit 12 which is supplied with cooling fluid by supply conduit 13. As mentioned before, the injected second stream of cooling fluid includes with the inner surface of wall 5 of the cooling zone 2 an angle between 70° to 90°, therefore the slot 10 is inclined relative to the inner surface of the wall 5 at an angle $\beta$ corresponding to the above range. The second stream of cooling fluid again forms within the cooling zone 2 a jacket stream having a configuration of a truncated cone or a closed flat ring which provides both the protection of the wall 5 against the deposit of sticky particles and the requisite cooling of the partial oxidation gas. Due to the novel combination of the two consecutive streams of cooling fluid injected through the ring-shaped slot 6 in the reactor vessel and through slot 10 in the cooling zone, the partial oxidation stream is now cooled in such a manner that the deposition of sticky impurities on the walls both in the transition region between the outlet of the reactor vessel and the cooling zone and the cooling zone itself is effectively prevented. The specific processing conditions which result through this combination have already been discussed before.

In the embodiment illustrated in FIG. 1, the inner diameter $d_1$ of the cooling zone below the ring-shaped slot 10 equals to the inner diameter $d_2$ above the slot 20. In a modification of this embodiment the diameter $d_2$ is larger than the diameter $d_1$. This configuration of the cooling zone is employed particularly in the case when a well-defined generation of the second jacket stream of cooling fluid parallel to the inner surface of wall 5 is desired. In general, for the configuration of the cooling zone 2 the following formula is valid:

$$\frac{d_1}{d_2} \leqq 1$$

In the embodiment of FIG. 2 the ring-shaped slot 6 results between two overlapping portions of the sloping wall of the outlet part of the reactor vessel 1. That means, the inner diameter of the frustoconical outlet portion of the reactor vessel 1 below the outlets of the gap 6 has a slightly smaller diameter than the overlapping portion above the gap 6. The circular distributing conduit 8 in this case is connected immediately to the inlet of the ring-shaped slot 6 so that the connection piece 7 is eliminated. The supply of cooling fluid into the circular conduit 8 is again provided with supply conduit 9. The stream of cooling fluid is injected from the inclined ring-shaped slot 6 in the direction of the arrow parallel to the inclined wall of the outlet portion of the reactor vessel 1 forming therewith an angle $\alpha=0°$. The wall 3 in FIG. 2 is a pipe wall through which a cooling medium is circulated. The inner wall of the reactor vessel below the slot 6 is again provided with a non-illustrated fireproof lining.

While the invention has been illustrated and described as embodied in cooling a stream of partial oxidation gas, it is not intended to be limited to the details shown, since various modifications and changes may be made without departing in any way from the spirit of the present invention. For example, this invention is applicable also for cooling other kinds of hot product gases entraining sticky particles which need not result from the partial oxidation of coal and/or other carbon carriers.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of cooling a stream of a product gas produced by partial oxidation produced at a temperature between 1,000° and 1,700° C. in a reactor vessel provided with a fireproof lining and having a conically converging outlet portion communicating with a tubular cooling zone, whereby the product gas stream flows through the outlet portion into the cooling zone, comprising the steps of injecting radially inwardly into the converging outlet portion a first stream of cooling fluid, said first stream having the shape of a closed flat ring which forms with the inner surface of the outlet portion an angle between 0° and 90°; and injecting radially inwardly into the tubular cooling zone a second stream of cooling fluid, said second stream having the shape of a closed flat ring which forms with the inner surface of the cooling zone an angle between 70° and 90° to prevent the formation of deposits of sticky particles contained in the product gas on the walls defining the converging outlet portion and the cooling zone.

2. A method as defined in claim 1 wherein the first and second ring-shaped streams of cooling fluid are branched from a recirculating partial stream of cool, purified partial oxidation gas.

3. A method as defined in claim 1 wherein the first ring-shaped stream of cooling fluid is injected into the reactor vessel with a velocity between 1 to 20 m/s, and the second ring-shaped stream of cooling fluid is injected into the cooling zone with a velocity between 4 to 40 m/s.

4. A method as defined in claim 3 wherein the ratio of volumes of said first ring-shaped stream to the second ring-shaped stream of cooling fluid is in the range between 1 and 4.

5. A method as defined in claim 4 wherein the mixture of the partial oxidation gas and the first ring-shaped stream of cooling fluid flows into the cooling zone with a velocity greater than 1 m/s.

* * * * *